US005987644A

United States Patent [19]

Mengato

[11] Patent Number: 5,987,644

[45] Date of Patent: Nov. 23, 1999

[54] ATHLETIC SHIRT AND BACKPACK COMBINATION

[76] Inventor: Richard A. Mengato, 2969 Kalakaua Ave., Honolulu, Hi. 96815

[21] Appl. No.: 09/048,265

[22] Filed: Mar. 26, 1998

[51] Int. Cl.[6] ..... A41B 1/12; A41D 1/12; A41D 1/00

[52] U.S. Cl. ..... 2/69; 2/94

[58] Field of Search ..... 2/69, 69.5, 89, 2/108, 102, 105, 106, 113, 114, 115, DIG. 2, 94

[56] References Cited

U.S. PATENT DOCUMENTS

| | | | |
|---|---|---|---|
| 1,088,891 | 3/1914 | Filson | 2/115 |
| 4,689,831 | 9/1987 | Greenberger et al. | 2/108 |
| 4,949,401 | 8/1990 | Kimsey, Jr. | 2/102 |
| 5,195,187 | 3/1993 | Yang | 2/108 |
| 5,418,978 | 5/1995 | Hochman | 2/69 |

*Primary Examiner*—John J. Calvert
*Assistant Examiner*—Shirra L. Jenkins
*Attorney, Agent, or Firm*—Carothers & Carothers

[57] ABSTRACT

An athletic shirt and backpack combination in the form of a vest of stretchable fabric having a back panel and a split access front panel with a conventional zipper closure and which snugly fits the upper torso of a body with a stretch fit. A backpack pocket panel of stretchable fabric is secured at its side and bottom edges to the back panel for providing a stretchable backpack pocket for containing objects with a stretch fit therein. Two horizontal wide straps of elastic material are secured across the front panel of the vest and connected to the side seams or side portions of the panel. The straps may be stretched and then connected with conventional hook and loop fasteners to securely hold the backpack with its load in position during athletic events.

9 Claims, 3 Drawing Sheets

ATHLETIC SHIRT AND BACKPACK COMBINATION

BACKGROUND OF THE INVENTION

The present invention pertains to athletic garments, and more particularly to an athletic shirt and backpack combination for sporting and other physical activities.

In many sport activities, such as running, jogging or bicycling, it is desirable to carry a backpack. However, conventional backpacks are not truly suited to such activities and they bounce and sway with the load thereby hindering the athlete from adequately performing the sport.

It is a principal object of the present invention to provide a combination athletic shirt and backpack which eliminates these deficiencies.

SUMMARY OF THE INVENTION

The athletic shirt and backpack combination of the present invention includes a vest, with or without sleeves as desired, of stretchable fabric such as manufactured and sold under the trademark Lycra. The vest is provided with a back panel and a split access front panel for snugly fitting an upper body torso with a stretch fit. A backpack pocket panel of stretchable fabric is secured at perimetrical portions thereof to the back panel for providing a stretchable backpack pocket for containing objects therein with a stretch fit. Normally the access for the pocket is provided at the upper end thereof as with a conventional pocket.

At least one horizontal strap, and typically two, are secured at their opposite ends to side portions of the front panel. These straps have an adjustable closure for opening and closing the straps. The straps are preferably also manufactured of stretchable material.

Two wide elastic straps are preferable and they attach to each side of the front panel of the shirt at the side seams. The straps fasten together at the front preferably by conventional hook and loop fasteners, such as Velcro fasteners, which are sewn to the elastic straps.

The split access front panel is preferably provided with a full length centered vertical zipper access for ease of donning and removing the shirt, even with a full backpack.

The backpack pocket may also be provided with a top access having a zipper closure and to protect it from the elements a cover flap may be disposed over the top access of the backpack pocket. Subpockets may also be provided within the backpack pocket to hold and isolate different objects therein. The subpockets are also preferably constructed of stretchable fabric.

The tension placed on the front elastic straps stretches and tightens the shirt material comprising the backpack storage pocket on the back of the shirt which greatly helps to decrease the motion or movement of the items within the backpack pocket or subpockets. The tension of the elastic straps around the body of wearer also directly inhibits motion of items carried in the backpack pocket or subpockets thereby stabilizing the carried load. Accordingly, the combination athletic shirt and backpack provides a great advantage in that it allows an athlete to carry loads during sport activities such as running or jogging while eliminating or minimizing the movement of the carried load, particularly bounce and sway of the load which is present when using a standard type of backpack. The design also eliminates standard backpack shoulder straps which allows increased freedom and comfort of motion of the arms and shoulders for the athlete. Movement and sliding of typical backpack shoulder straps, which inhibits the athlete, is also eliminated. This adds greatly to the convenience and comfort of carrying loads during sport activities.

The stretch design of the athletic shirt and backpack combination of the present invention also holds the load closely against the body thus decreasing the moment-arm of the load from the center of gravity of the body thereby decreasing the forces on the spine and muscles of the back.

Such stretchable fabrics as Lycra is comfortable to wear and is generally considered appealing from a fashion standpoint, particularly in athletic events.

The athletic shirt and backpack combination of the present invention can be worn as a primary shirt or can be worn over other garments, including shirts, sport bras or jackets, much as a regular backpack would be worn. The athletic garment is also readily washable.

In addition, the combination athletic shirt and backpack of the present invention is very light weight and can be conveniently folded to small size for packing and traveling. Upon reaching ones designation, the combination athletic shirt and backpack of the present invention can be used in and of itself as a lightweight backpack at ones destination.

The athletic shirt and backpack combination of the present invention is extremely useful for a number of sporting activities which require a stable load and freedom of movement of ones arms, including running or jogging, in-line skating, cross country skiing, snow shoeing, hiking, rock climbing, bicycling and canoeing. It can also be used as a comfortable way to carry items while leaving ones hands free, such as carrying a towel, book or drinking water in nonsport activities such as going to the beach or shopping.

Of course various fashion aspects may also be added to the athletic shirt and backpack combination of the present invention in terms of fabric color and incorporation of logos, decorations, etc. For night use, reflective material or strips may also be incorporated on external portions of the fabric for safety.

BRIEF DESCRIPTION OF THE DRAWINGS

Other objects and advantages appear hereinafter in the following description and claims. The accompanying drawings show, for the purpose of exemplification, without limiting the invention or claims thereto, certain practical embodiments of the present invention wherein:

DETAILED DESCRIPTION OF A PREFERRED EMBODIMENT

Figure 1:
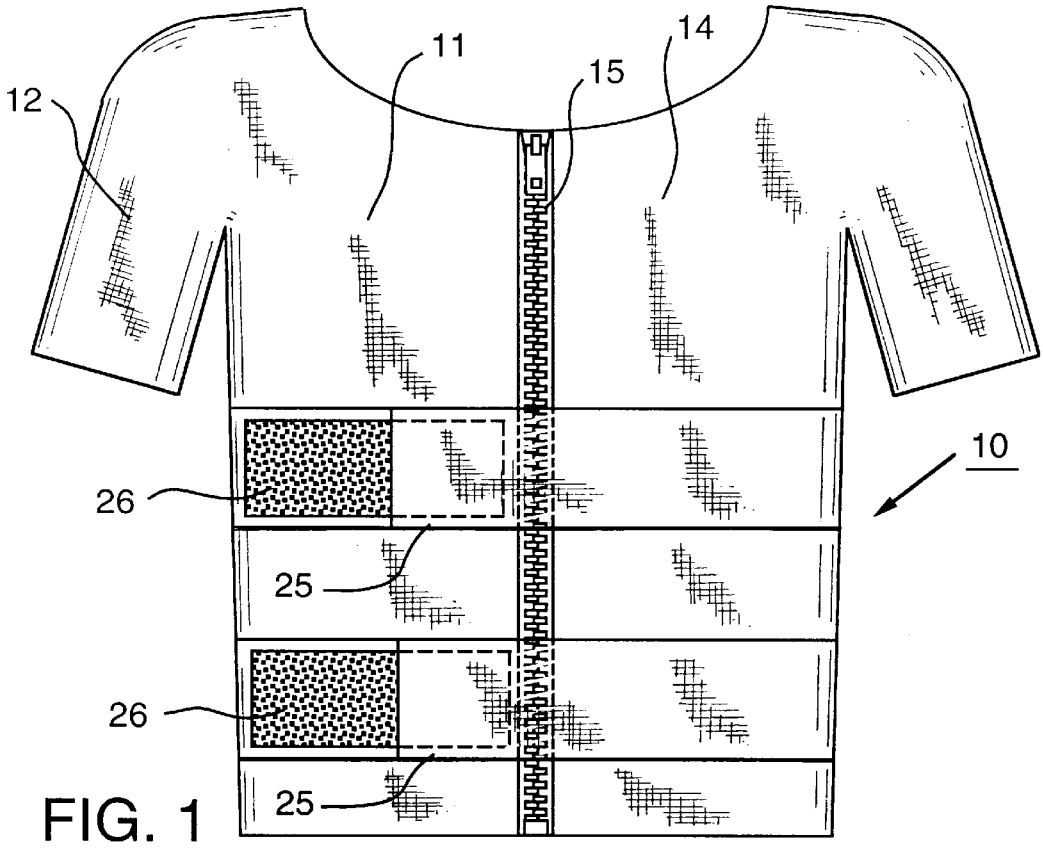
FIG. 1 is a view in front elevation of the athletic shirt and backpack combination of the present invention as being worn on the upper torso of an athlete.
Figure 2:
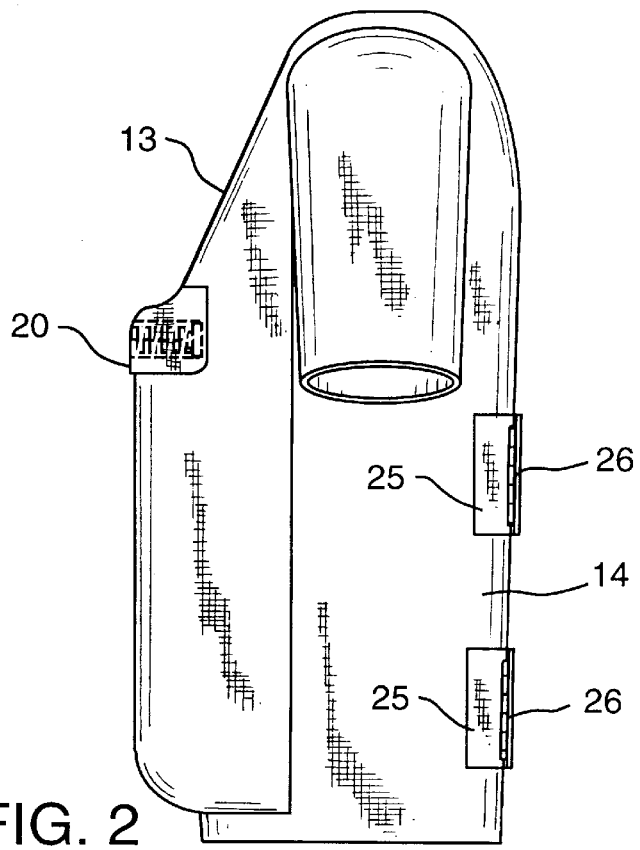
FIG. 2 is a view in right side elevation of the athletic shirt and backpack combination shown in FIG. 1.
Figure 3:
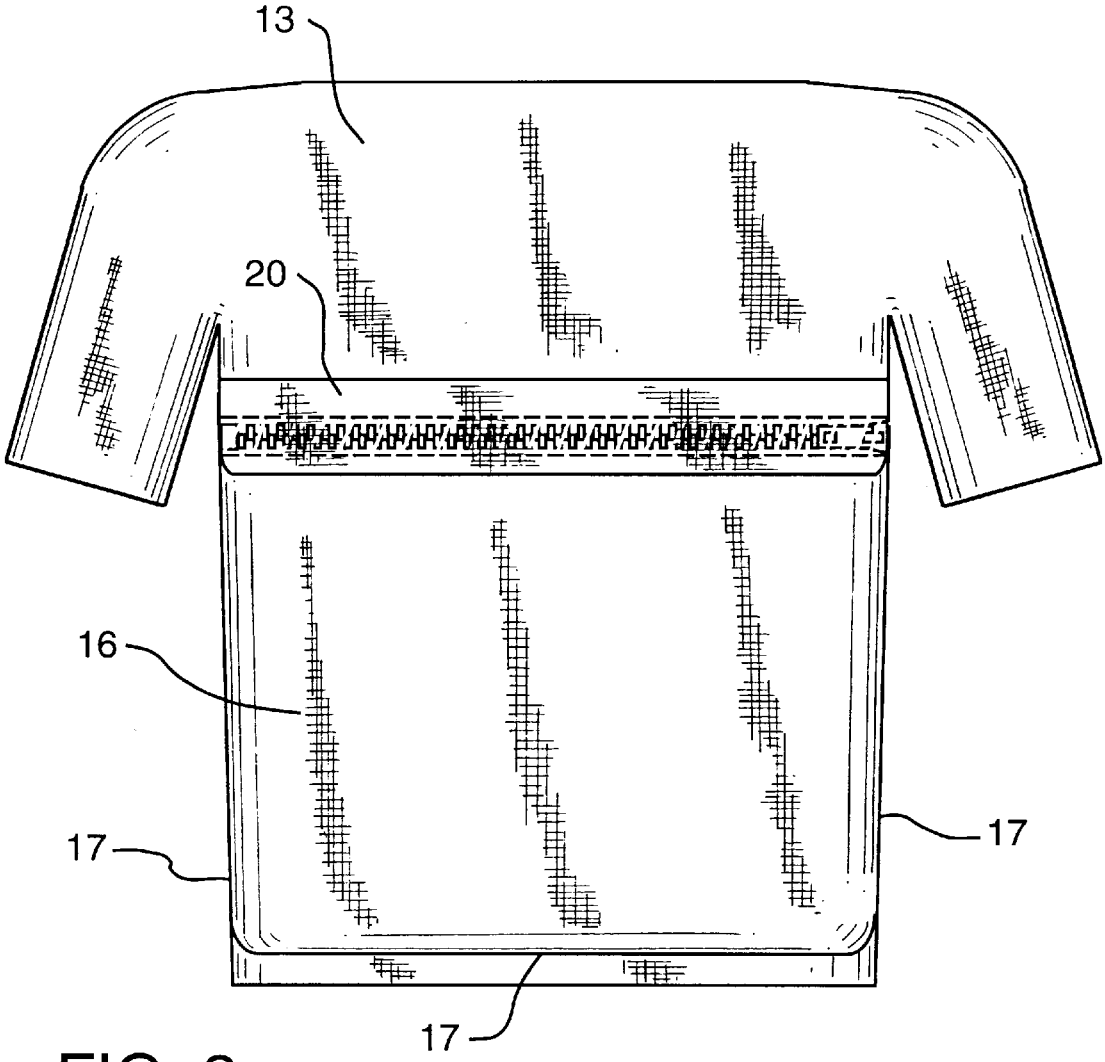
FIG. 3 is a view in back elevation of the athletic shirt and backpack combination shown in FIGS. 1 and 2.

Referring to the drawings, the athletic shirt and backpack combination 10 of the present invention is a vest structure 11 with short sleeves 12 (sleeves being optional) of stretchable Lycra fabric having a back panel 13 connected at side seams and at the top over the shoulders to split access front panel 14 having a full length vertical access zipper 15.

This stretchable fabric vest snugly fits over the upper body torso as illustrated in the figures with a stretch fit.

A backpack pocket 16, also constructed of stretchable Lycra fabric, is secured at its perimetrical portions 17 to back panel 13 for providing a stretchable backpack pocket with top access 18 which is fully closeable with zipper 19 and is further provided with a short overlapping flap 20 to protect it from the elements.

Figure 4:
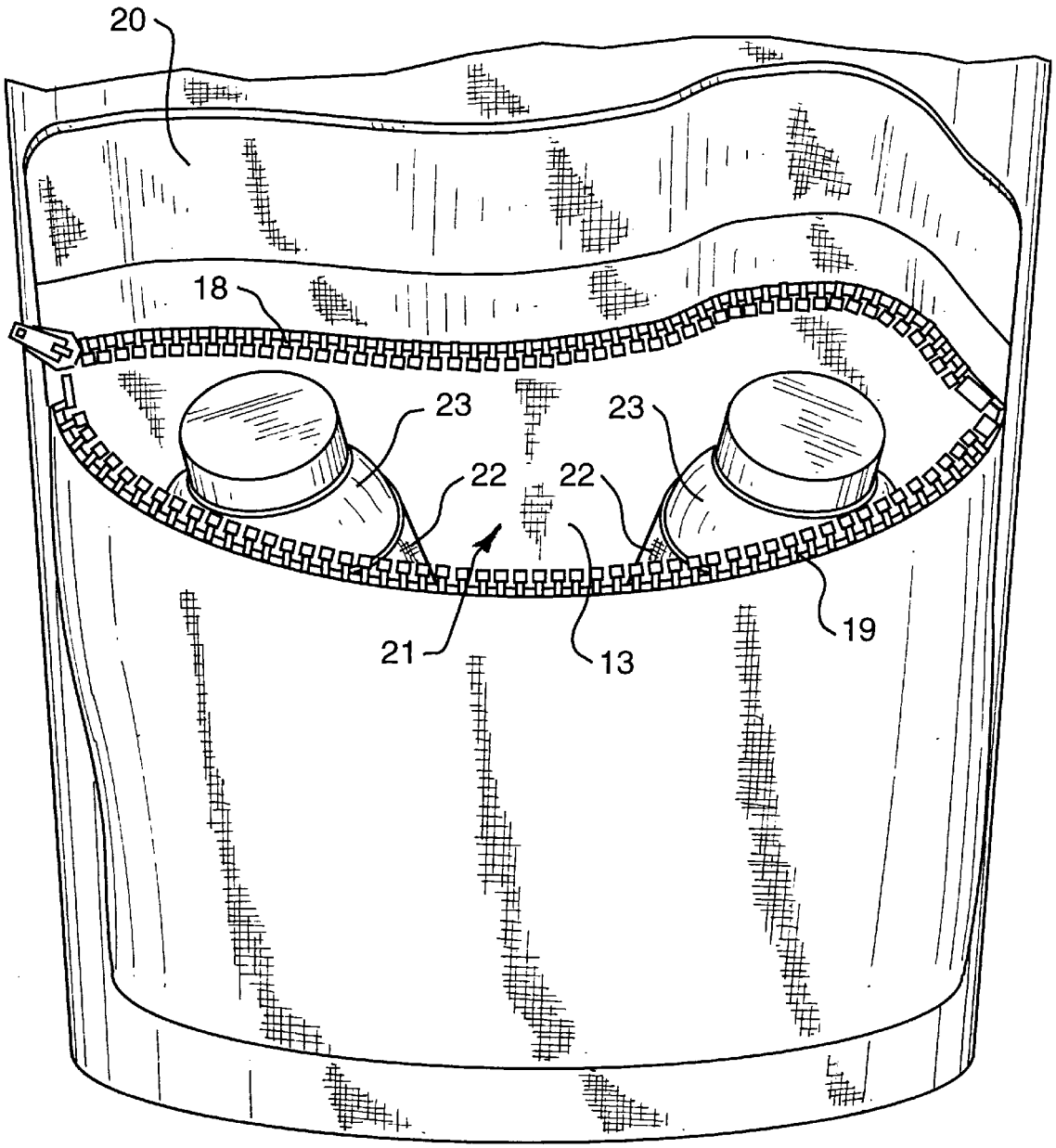
FIG. 4 is an enlarged perspective view of the backpack pocket of the athletic shirt and backpack combination shown in FIG. 3 with the backpack pocket stretched open to disclose the interior thereof.

The backpack of pocket 21 further includes subpockets 22 therein of stretchable fabric for holding and isolating bottles or objects 23 therein as illustrated in FIG. 4.

The split access front panel 14 of the stretchable vest structure is provided with two horizontal upper and lower stretchable straps 25 which are secured at their opposite side ends at the side seams of the vest and sewn into the vest at the side seams.

Both stretchable straps 25 are provided with closures 26 in the form of conventional Velcro hook and loop fasteners.

Accordingly, stretchable front straps 25 may be stretched tight and then closed at their closures 26 to securely hold backpack pocket 16 in position thereby preventing it from bouncing or swaying.

I claim:

1. An athletic shirt and backpack combination comprising: a shirt of stretchable fabric having a back panel and a split access front panel for snugly fitting an upper body torso with a stretch fit; a backpack pocket panel of stretchable fabric secured at perimetrical portions thereof to said back panel for providing a stretchable backpack pocket for containing objects therein with a stretch fit; and at least one stretchable horizontal strap secured at opposite ends thereof to side portions of said front panel; said at least one strap having an adjustable closure for opening and closing said at least one strap across said front panel.

2. The athletic shirt and backpack combination of claim 1 wherein said adjustable closure is a hook and loop closure.

3. The athletic shirt and backpack combination of claim 2 including two of said straps positioned in spaced relationship one above the other.

4. The athletic shirt and backpack combination of claim 1 wherein said split access front panel has a centered vertical full zipper access.

5. The athletic shirt and backpack combination of claim 1 wherein said backpack pocket has a top access with a zipper closure.

6. The athletic shirt and backpack combination of claim 1 wherein said backpack pocket has a top access and a cover flap disposed over said top access.

7. The athletic shirt and backpack combination of claim 1 wherein said backpack pocket includes subpockets therein secured to said back panel for holding and isolating objects in said backpack pocket.

8. The athletic shirt and backpack combination of claim 7 wherein said subpockets are of stretchable fabric.

9. The athletic shirt and backpack combination of claim 1 including arm sleeves on said vest.

* * * * *